US005573019A

United States Patent [19]

Hempel

[11] Patent Number: 5,573,019

[45] Date of Patent: Nov. 12, 1996

[54] HYGIENIC FRICTIONAL TOOTHBRUSH HOLDER

[76] Inventor: Jeffrey D. Hempel, 33710 Santiago Rd., Acton, Calif. 93510

[21] Appl. No.: 328,039

[22] Filed: Oct. 24, 1994

[51] Int. Cl.[6] ..... A45D 44/18; A46B 17/02; A47B 81/02

[52] U.S. Cl. ..... 132/310; 132/308; 15/167.1; 15/257.01; 211/65; 211/87; 248/111; 248/309.1; D4/108; D6/534

[58] Field of Search ..... 15/167.1, 167.2, 15/257.01; 132/308, 310; 211/60.1, 65, 66, 87; 248/110, 111, 113, 205.3, 309.1, 683; D4/108; D6/534

[56] References Cited

U.S. PATENT DOCUMENTS

| | | | |
|---|---|---|---|
| 1,491,994 | 4/1924 | McDermott | 132/310 |
| 1,546,548 | 7/1925 | MacCune | 211/66 |
| 1,571,000 | 1/1926 | Eustis | 248/113 |
| 2,259,848 | 10/1941 | Ward | 132/308 |
| 2,591,805 | 4/1952 | Gossett | 211/89 |
| 2,797,886 | 7/1957 | Pinckney | 248/113 |
| 2,937,910 | 5/1960 | Randa | 348/113 |
| 3,002,630 | 10/1961 | Heisser | 211/65 |
| 3,002,798 | 10/1961 | Corley | 132/308 |
| 3,531,072 | 9/1970 | Lindquist | 248/113 |
| 3,946,877 | 3/1976 | Galicia | 248/205.3 |
| 3,995,743 | 12/1976 | Blackburne | 211/65 |
| 4,589,159 | 5/1986 | Streibel | 15/167.1 |
| 4,854,457 | 8/1989 | Perler | 211/65 |
| 4,979,708 | 12/1990 | Aoki | 248/110 |
| 5,163,566 | 11/1992 | Hempel | 248/110 |
| 5,259,519 | 11/1993 | Lieberman | 248/205.3 |
| 5,269,420 | 12/1993 | Harrison et al. | 206/362.3 |
| 5,301,821 | 4/1994 | Jeannet et al. | 211/65 |
| 5,335,798 | 8/1994 | Bonwell et al. | 211/65 |
| 5,369,835 | 12/1994 | Clarke | 248/110 |

*Primary Examiner*—Mark Spisich
*Attorney, Agent, or Firm*—Poms, Smith, Lande & Rose, P.C.

[57] ABSTRACT

A hygienic frictional toothbrush mounting system includes a mounting member or holder and at least one toothbrush. The mounting member is formed of translucent plastic and includes at least one recess for receiving the toothbrush. The recess is shaped to position the toothbrush laterally and vertically within the recess. The recess shape is customized to correspond to the shape of a particular brand or type of toothbrush to be held. The translucent configuration of the mounting member permits easy visual inspection of the system to ensure hygienic cleanliness of the system. A toothbrush includes a handle region having a predetermined surface contour, and a mounting member includes a recess having a recessed surface contour for engaging the predetermined surface contour of the toothbrush handle region. The toothbrush is secured in the mounting member by friction between portions of the engaged surface contours. The mounting member is affixed to a vertical surface such as a wall or mirror. The bristles of the toothbrush are held in a hygienic position, free from interference with portions of the holder or other objects. The toothbrush is neatly and securely held in a convenient, out of the way location.

13 Claims, 2 Drawing Sheets

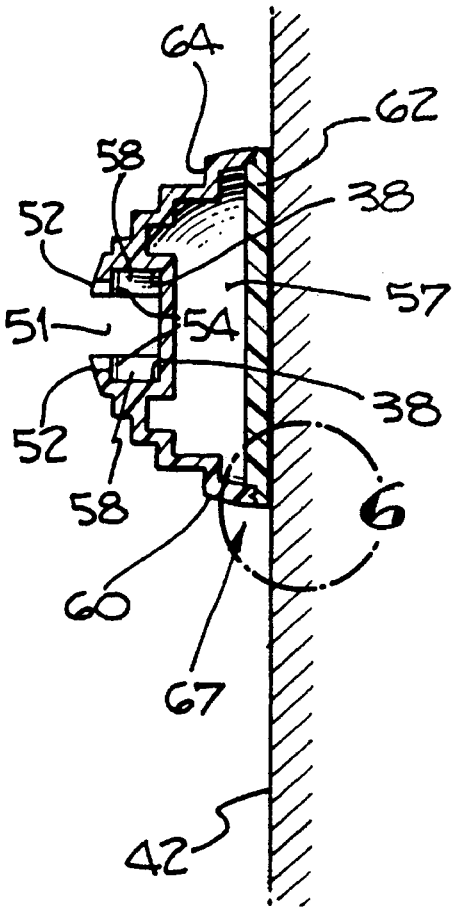
Fig. 5
Fig. 6.
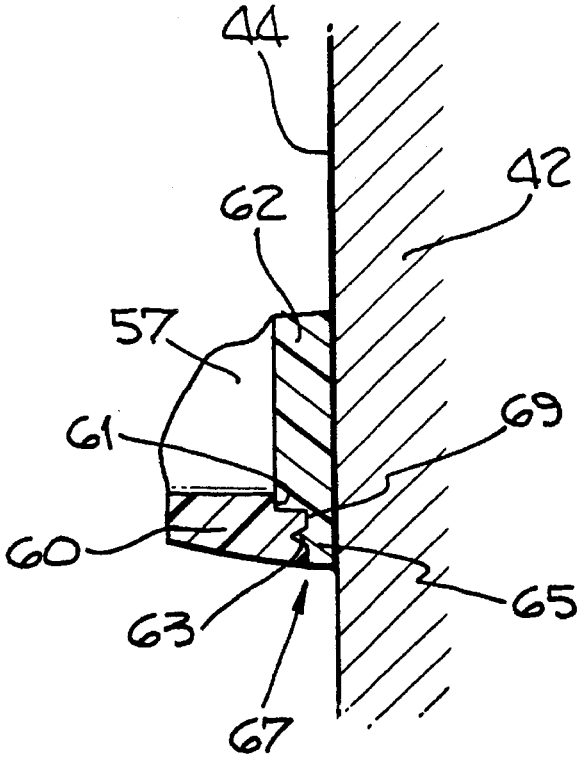
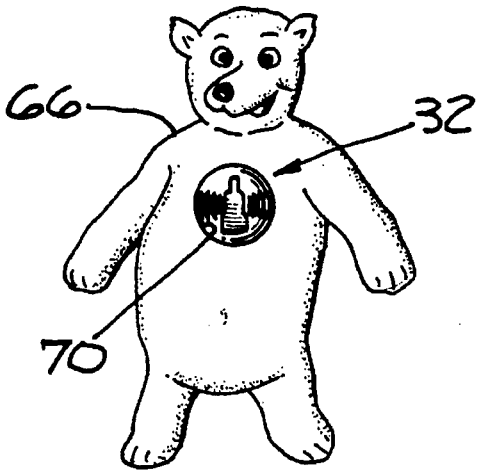
Fig. 7.
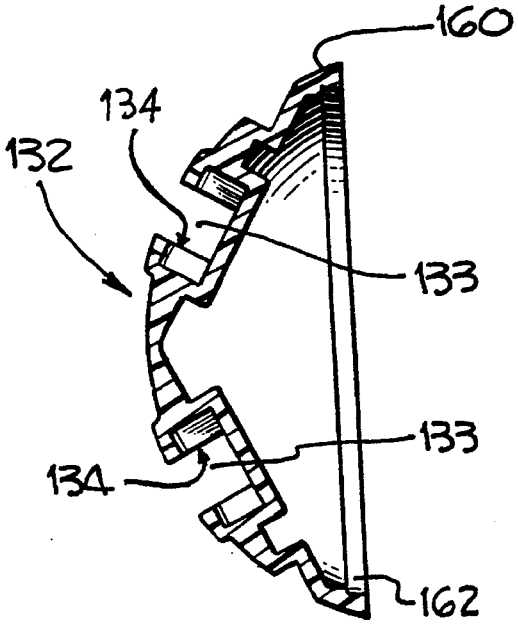
Fig. 8.

HYGIENIC FRICTIONAL TOOTHBRUSH HOLDER

FIELD OF INVENTION

This invention relates to toothbrush holders, and more particularly to toothbrush holders using friction to hold a particularly shaped toothbrush in a correspondingly shaped holder.

BACKGROUND OF INVENTION

In the past, various types of toothbrush holders have been used for storing toothbrushes when not in use. The holders include cup-type holders, and other types of holders that are mounted to a bathroom wall. However, a recurring problem with the known toothbrush holders is their inability to maintain the toothbrush in the hygienic manner desired for a toothbrush. Also, known toothbrush holders have not held the handle in a relatively secure, precise manner, adaptable to various handle orientations such as upright, sideways, or upside down, wherein the toothbrush cannot be easily dislodged from the holder by accidental contact with the toothbrush handle. Similarly a toothbrush mounting system has not been provided which is adapted to conveniently, securely, and precisely hold a predetermined brand or type of conventional toothbrush. Known toothbrush holders have also failed to provide a relatively inexpensive frictional mounting system for a toothbrush which is adaptable to provide a substantially aesthetically pleasing appearance and which also provides substantial ease of use, reliability, and convenience.

For example, the wall mounted toothbrush holders typically include apertures wherein the handle portion of the toothbrush is inserted into the holder, and the bristles of the toothbrush rest on the holder, preventing the toothbrush from falling through the apertures. The problem with this type of holder is that the bristles are forced to contact the holder when the toothbrush is not in use. Because the toothbrush is inserted into the holder while the bristles are still wet, bacteria and contaminants tend to develop in the area of the holder surrounding the bristles. Therefore, the toothbrush is not stored in a hygienic manner.

Other types of toothbrush storage, such as devices which encapsulate the bristles of the toothbrush, prevent ventilation through the bristles. As a result, the toothbrush bristles do not completely dry between uses, and the bristles are subject to the growth of bacteria.

Cup-type holders collect sediment in the bottom of the cup or container and are normally placed inconveniently on a basin surface. Such holders are easily knocked over and do not hold toothbrushes in a secure, convenient, out of the way manner which is also aesthetically pleasing in a lavatory environment.

Various types of implement holders, including toothbrush holders, have been provided which each fail to provide a convenient, inexpensive, relatively secure, hygienic toothbrush mounting system. Similarly, a particularly shaped holder corresponding to a toothbrush with a predetermined shape and suitable for sale with individual toothbrushes has not been provided in the art. For example, H. E. Gossett U.S. Pat. No. 2,591,805 shows an implement holder having a pair of face plates engaging an implement from the sides by compressing a plurality of adjacent resilient block regions disposed between sets of face plates. This arrangement is complicated and poorly adapted to the hygienic storage of a toothbrush, especially in a lavatory environment. Another reference describing an article holder suffering similar disadvantages is J. P. Eustis U.S. Pat. No. 1,571,000. Eustis shows a rack including undulating webs for receiving articles such as toothbrushes, which appear to hang loosely in the web opening with the bristles contacting the webs. Hence, this arrangement is also not well suited for precise, relatively hygienic, aesthetically pleasing storage of a toothbrush.

Similarly, A. S. Pinckney U.S. Pat. No. 2,797,886 fails to provide optimum hygienic storage of a toothbrush since the bristles are in contact with opposite wall portions of a resilient slot opening. Blackburne U.S. Pat. No. 3,995,743 also provides a device wherein the bristles of a toothbrush are in contact with the inner side surfaces of a channel in a relatively non-hygienic manner. A reference disclosing yet another relatively non-hygienic toothbrush holder is Aoki U.S. Pat. No. 4,979,708, wherein the bristles of the toothbrush rest on a holding arm extending outward from a casing body affixed to a wall.

Several references show devices for suspending toothbrushes in a relatively imprecise, awkward, specialized, or loose manner. For example, A. M. Lindquist U.S. Pat. No. 3,531,072 describes a holder formed of sheet material wherein an aperture is connected with an edge portion of a platform element by a narrow slot with outwardly diverging sides. A brush neck is shifted broadside edgewise toward said slot with the brush inclined from a vertical and deflects said slot sides upwardly and downwardly to widen said slot to admit said brush neck into said aperture. However, the toothbrush handle is not held in a relatively secure, substantially upright and precise manner. The toothbrush can be easily dislodged from the holder by accidental contact with the awkwardly angled toothbrush handle. R. E. Heisser U.S. Pat. No. 3,002,630 describes a toothbrush rack exhibiting similar disadvantages. A disposable portion includes a plurality of slots each including narrow intermediate portions. The relatively narrow neck portion of a toothbrush is inserted edgewise into one of said slots and after passing the narrow intermediate portion the brush is turned 90 degrees to be retained in the slot.

Harrison et. al U.S. Pat. No. 5,269,420 and Streibel U.S. Pat. No. 4,589,159 both describe toothbrush holders which include a mounting arrangement for receiving an enlarged shape or disc-shaped portion of an adapted toothbrush so that the non-conventional toothbrush is invertedly supported by the mounting arrangement. These references both disadvantageously require and are exclusively limited to be used with a specially designed toothbrush, rather than being adapted to conveniently, securely, and precisely hold a predetermined brand or type of conventional toothbrush.

Perler U.S. Pat. No. 4,854,457 describes prongs made of semi rigid plastic for applying a spring force to a toothbrush handle, the prongs being mounted on a mounting plate affixed to a wall. The insertion and removal of a toothbrush handle from said prongs would appear to require the awkward application of an inward or outward force for forcing an opening movement of the prongs. This makes the use of the holder less convenient or desirable and also appears to increase the likelihood of breakage of the holder. The holder also does not appear to be adaptable to provide an aesthetically pleasing appearance.

Accordingly there has not been provided a hygienic toothbrush mounting system for holding the toothbrush handle in a relatively secure, substantially upright and precise manner wherein the toothbrush cannot be easily dislodged from the holder by accidental contact with the toothbrush handle. Similarly a mounting system has not been provided which is adapted to conveniently, securely, and precisely hold a predetermined brand or type of conventional toothbrush. Existing toothbrush holders have also failed to provide a relatively inexpensive frictional mounting system for a toothbrush which has an aesthetically pleasing appearance, is easily cleaned, mounted, and replaced, and which also provides substantial ease of use, reliability, and convenience.

SUMMARY OF INVENTION

Accordingly, a hygienic toothbrush mounting system is disclosed embodying principles of the present invention. A hygienic toothbrush mounting system is provided for holding the toothbrush handle in a relatively secure, substantially upright and precise manner wherein the toothbrush cannot be easily dislodged from the holder by accidental contact with the toothbrush handle. Similarly, the present mounting system is adapted to conveniently, securely, and precisely hold a predetermined brand or type of conventional toothbrush. The present invention further embodies principles of a relatively inexpensive frictional mounting system for a toothbrush which is adaptable to provide a substantially aesthetically pleasing appearance and which also provides substantial ease of use, reliability, and convenience.

Accordingly, in one broad aspect embodying principles of the present invention, a hygienic toothbrush mounting system comprises a toothbrush including a handle region having a predetermined surface contour, and a mounting member having a recessed surface contour for engaging the predetermined surface contour of the toothbrush handle region. The toothbrush is secured in the mounting member by friction between portions of the engaged surface contours. The mounting member is affixed to a vertical surface such as a wall or mirror. The bristles of the toothbrush are held in a hygienic position, free from interference with portions of the holder or other objects. The toothbrush is neatly and securely held in a convenient, out of the way location.

In another broad aspect embodying principles of the present invention, a hygienic toothbrush mounting system comprises a toothbrush and a toothbrush mounting member or holder. The toothbrush is one of any conventional brand or type which includes bristles and a handle. The handle normally has a relatively uniform thickness and includes a front surface, a rear surface, and side surfaces. The handle also normally includes a head portion, a body portion, a relatively narrow neck portion disposed between the head portion and the body portion, and a shoulder region or shank having sloped shoulder surfaces on the sides of the handle where the neck portion adjoins the body portion. The bristles are mounted on the head portion of the handle and the toothbrush is gripped in the user's hand by the body portion of the handle.

The shoulder region or shank has a predetermined surface contour comprising the sloped shoulder surfaces, a portion of the front surface associated with each of the neck portion and the body portion, a portion of the rear surface associated with each of the neck portion and the body portion, and a portion of the side surfaces associated with each of the neck portion and the body portion.

The toothbrush holder includes a mounting portion and a mounting plate. The mounting plate includes a flange for engaging an inset region at the back of the mounting portion. The mounting portion preferably comprises a rigid geometric shape formed of colored, clear, or translucent plastic material. The geometric shape preferably has a thickness in excess of the toothbrush handle thickness. Preferably, the geometric shape of the mounting portion is provided as a substantially semi-spherical shape.

The mounting portion further includes a recess, and an inset as mentioned above. The recess provides on its inner surface a recess surface contour comprising a slot and opposing grip regions.

The slot has a rear surface and side surfaces orthogonally adjacent the rear surface. The slot includes a relatively wide body opening or channel adapted to receive the body portion of the toothbrush; a relatively narrow neck opening or channel disposed above the body opening and adapted to receive the neck portion of the toothbrush; and sloped shoulder portions disposed symmetrically on each side of the slot. The sloped shoulder portions adjoin the sides of the neck opening with the sides of the body opening on each side of the slot. The slot has a depth which exceeds the thickness of the toothbrush handle in the shoulder or shank region.

The opposing grip regions are disposed symmetrically on each side of the body opening of the slot. The opposing grip regions are also disposed substantially near the front of the body opening. The opposing grip regions each partially overlap the front of the body opening of the slot. A space is provided between the two grip regions such that the two grip regions are closer in proximity to each other than the side walls of the body opening but are further away from each other than the side walls of the neck opening.

Each opposing grip region includes a grip surface facing substantially in an opposing direction to the rear surface of the slot. The grip surface preferably includes a gradual taper or angular setoff with respect to a plane parallel to the rear surface of the slot. Each grip surface engages a partial portion of the body portion of the handle, comprising the front side edges of the body portion in the shoulder or shank region, when the toothbrush is inserted into the holder.

The inset previously mentioned preferably comprises a ledge at the rear of the toothbrush mounting portion. The mounting plate flange engages the inset providing a lapped corner joint for securing the mounting plate to the toothbrush mounting member. An ultrasonic welding technique may be used to weld the plastic parts together at the corner joint.

In use, the holder is preferably, but not necessarily affixed to a vertical surface using adhesive or adhesive tape applied to a rear surface of the mounting plate. Preferably the neck opening of the slot is oriented in an upward position and the body opening of the slot is oriented in a downward position. This orientation places the neck opening at the top of the holder and the body opening at the bottom of the holder, with the recess accessible at the front of the holder. However, other orientations of the holder are easily provided.

The toothbrush is secured in the toothbrush holder by substantially engaging the shoulder surface contour in the recess surface contour by sliding the shoulder region into the recess using an upward motion of the handle. Friction between portions of the engaged surface contours secures the toothbrush in the holder until removed by a user applying a downward force to the handle. The friction is largely developed by wedging the shoulder or shank region of the toothbrush body portion between each of the opposing tapered grip surfaces and the rear slot surface. The slot side walls preferably guide and contain the handle against rotational motion in the holder.

These and other objects, features and advantages, of the present invention will now become apparent from a review of the drawings and the following description of the preferred embodiment.

BRIEF DESCRIPTION OF THE DRAWINGS

FIG. 5 is a section view of the frictional toothbrush holder of FIG. 1 taken from the plane 5—5 of FIG. 2;

FIG. 6 is a detailed sectional view as shown circled in FIG. 5 illustrating one type of joint between a toothbrush mounting portion and a mounting plate of the frictional toothbrush holder of FIG. 1;

FIG. 7 illustrates an ornamental design provided in conjunction with the frictional toothbrush holder of FIG. 1; and FIG. 8 is a sectional view of a frictional toothbrush holder for holding two toothbrushes embodying principles of the present invention.

DETAILED DESCRIPTION OF THE PREFERRED EMBODIMENTS

Figure 1:
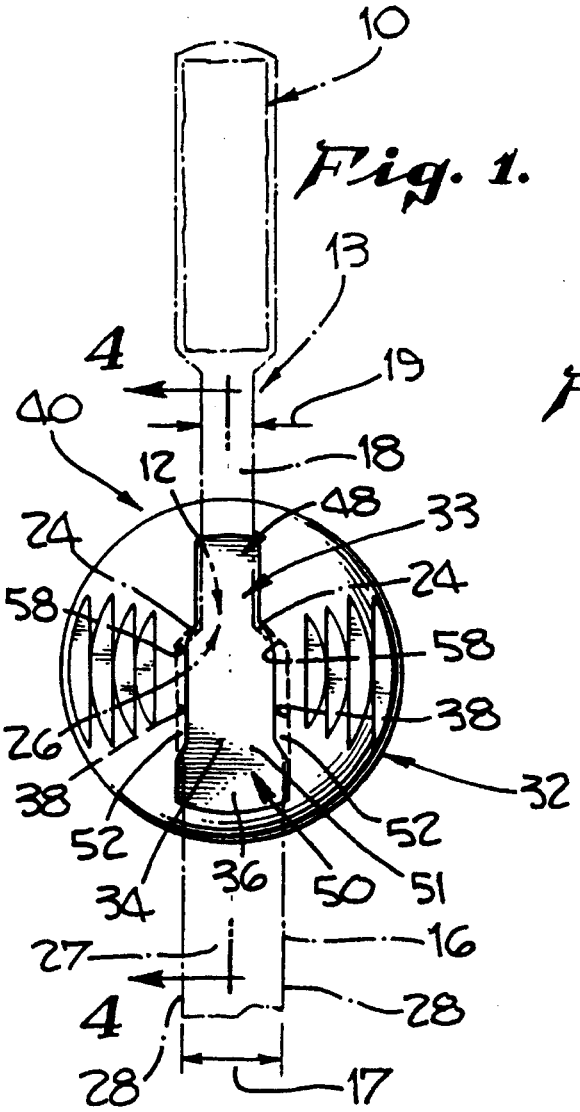
FIG. 1 is a front view of a frictional toothbrush holder illustrating principles of the present invention.
Figure 2:
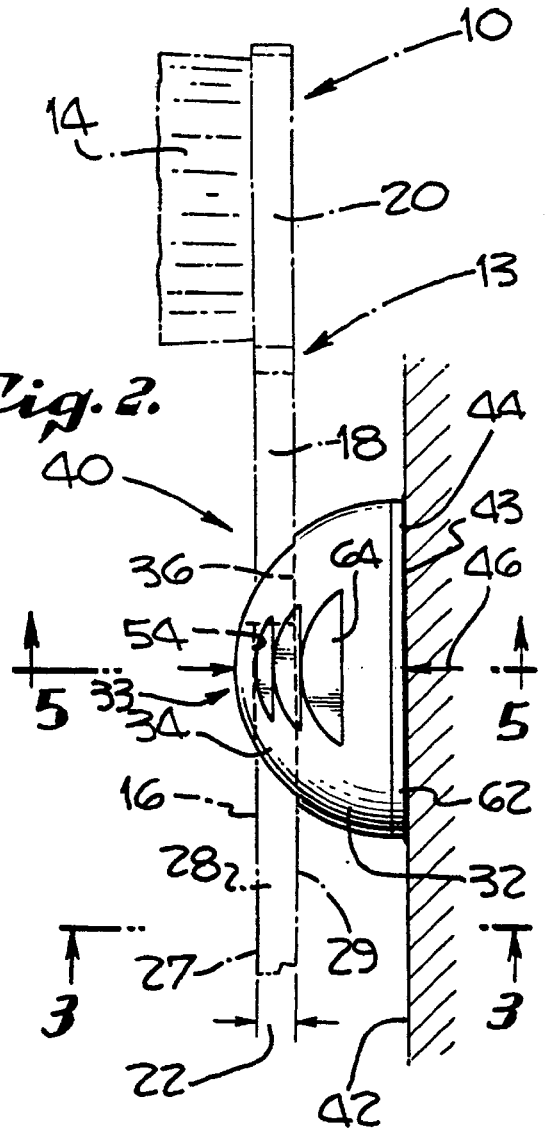
FIG. 2 is a right side view of the frictional toothbrush holder of FIG. 1.

As illustrated in FIG. 1, a hygienic frictional toothbrush mounting system 40, embodying principles of the present invention, is shown. Toothbrush 10, comprising any one of a particular brand or type of toothbrush conventionally available, is inserted into corresponding mounting member or holder 32. A frictional force is provided by an interference, or contact fit between adjacent surface contours of a toothbrush handle 13 and a recess 33 that secures toothbrush 10 to holder 32. Holder 32 is preferably secured to a wall, mirror, or other vertical surface 42 (as illustrated in FIG. 2). Thus, toothbrush 10 is mounted or held in a secure, convenient, hygienic manner.

As best illustrated in FIGS. 1 and 2, toothbrush 10 is a conventional instrument and further comprises bristles 14 mounted on head portion 20 of handle 13. Handle 13 also includes a relatively narrow neck portion 18 and a relatively wide body or grip portion 16. Neck portion 18 is disposed between head portion 20 and body portion 16. Neck portion 18 has predetermined neck width 19. Body portion 16 has predetermined body width 17.

Shoulder or shank region 12 is formed where the neck portion 18 adjoins the body portion 16. Two shoulder surfaces 24 are disposed symmetrically on opposing sides of the center of both the neck portion 18 and of the body portion 16. The shoulder surfaces 24 typically are sloped, and provide an angled, gradual transition from the relatively narrow neck width 19 to the relatively wide body width 17. The shoulder region 12 has a predetermined thickness 22 as illustrated in FIG. 2. Typically, the thickness 22 is substantially the same for neck portion 18, body portion 16 and shoulder region 12 for a conventional toothbrush 10.

The handle 13 has front surface 27, side surfaces 28 and rear surface 29. A shoulder surface contour, or predetermined mounting surface 26 is formed or provided substantially in the shoulder region 12 where neck 18 adjoins body 16. Accordingly, the shoulder surface contour 26 comprises portions of front surface 27, side surfaces 28, rear surface 29, and sloped shoulder surfaces 24. The shape and dimensions of shoulder surface contour 26 are based on body width 17, neck width 19, shoulder thickness 22, and the length (angle) of sloped shoulder surfaces 24, for a particular type or brand of toothbrush 10. Hence, the shoulder surface contour or predetermined mounting surface 26 has a thickness 22 and side profiles associated therewith.

The foregoing generalized details are typical of conventional brands and types of toothbrush 10. For any particular type or brand of toothbrush 10, the shape and dimensions of shoulder surface contour 26, or an analogous mounting surface, are readily determined. The particular shape and dimensions of shoulder surface contour 26 are preferably used to derive or provide the shape and dimensions of a recessed surface contour 34 associated with a recess 33 disposed in the mounting member or holder 32.

Mounting member or toothbrush holder 32 is formed of rigid material, which can be colored but is preferably translucent or clear plastic. As illustrated in FIG. 2, a back or rear surface 43 of holder 32 is mounted on vertical surface 42. Holder 32 has a geometric shape, such as the semi-spherical shape shown in the figures, having a thickness 46 which exceeds, or is greater than the thickness 22 of shoulder region 12 of toothbrush 10 (see FIG. 2). Although a semi-spherical shape is preferred, other shapes could easily be provided for holder 32 in accord with principles of the present invention. For example, holder 32 could be provided in various box shapes or in the shape of various conic or spherical sections.

As illustrated in FIGS. 1–4, recess 33 has an inner surface, or recessed surface contour 34 having a relatively precise shape and dimensions corresponding to the predetermined shape and dimensions of shoulder surface contour 26. Hence, toothbrush holder 32 is provided with a relatively precise recessed surface contour 34 to fit a specific brand or type of toothbrush 10.

To secure the toothbrush 10 in holder 32, shoulder region 12 of handle 13 is inserted into recess 33. This insertion engages the shoulder surface contour 26 against and in contact with a substantial portion of the recessed surface contour 34, causing a static frictional force. Toothbrush 10 is held securely in holder 32, in an upright, secure, hygienic position, by the frictional force generated by the substantial contact of shoulder surface contour 26 with recessed surface contour 34.

The depth of the recess 33 is adequate to encompass the predetermined mounting surface thickness 22. Grip regions 52 extend around the handle 13 to restrain it against movement directly outwardly from the holder 32, as will be discussed more fully below. The predetermined mounting surface 26 and the recess 33, in broad principle, have a gradually tapered interference fit therebetween to retain the toothbrush 10 in the holder 32. Although a particular interference fit is described below, the gradual taper 56 could be provided at various locations on either the toothbrush mounting surface 26 or within the recessed surface contour 34.

Figure 4:
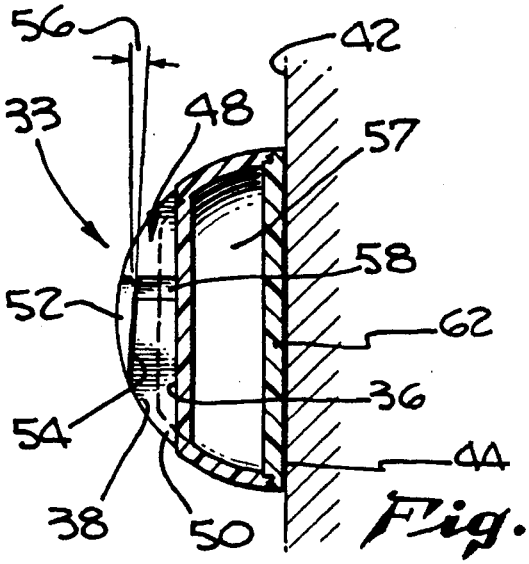
FIG. 4 is a sectional view of the frictional toothbrush holder of FIG. 1 taken from the plane 4—4 of FIG. 1.
Figure 3:
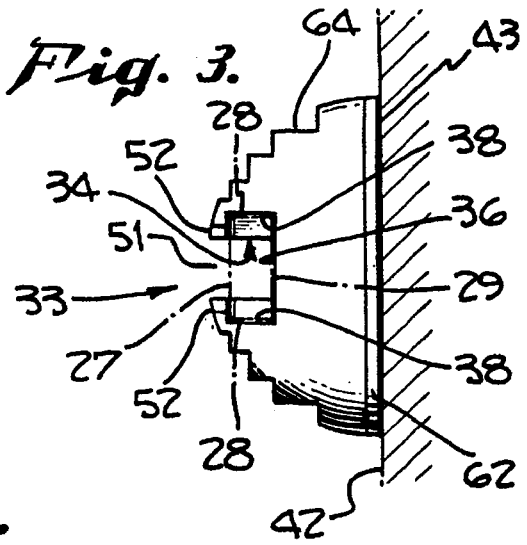
FIG. 3 is a bottom view of the frictional toothbrush holder of FIG. 1 taken from the plane 3—3 of FIG. 2.

As best illustrated in FIGS. 2 and 4, recess 33 includes a back or rear surface 36 for partially engaging a portion of the back surface 29 of toothbrush handle 13. As best illustrated in FIGS. 1, 3 and 4, recess 33 also includes side surfaces 38 for partially engaging, or guiding a portion of side surfaces 28 of toothbrush handle 13. Preferably, side surfaces 38 of recess 33 are relatively narrowly spaced in a recess neck opening 48 (see FIG. 1) and are relatively widely spaced in a recess body opening 50 to guide or engage the respective portions of shoulder region 12 of toothbrush handle 13. The side surfaces 38 also include a sloped portion 58 adjoining the relatively narrow neck opening 48 to the relatively wide body opening 50. A slot 51 is thereby provided between side surfaces 38 having a depth extending to the back surface 36.

Recess 33 also includes ledge portions or opposing grip regions 52 disposed symmetrically on each side of slot 51. Grip regions 52 preferably are also disposed substantially near the front of slot 51 and each include a grip surface 54 for engaging or contacting a partial portion of front surface of shoulder region 12 of toothbrush handle 13. Grip surfaces 54 are disposed substantially in opposition to back surface 36 of recess slot 51. In other words, the normal vector for each grip surface 54 is oriented approximately 180 degrees from the normal vector of the back surface 36, except for an angular or gradual taper 56 as best illustrated in FIG. 4.

Angular or gradual taper 56 is preferably approximately three degrees sloping toward back surface 36 near the top portion of holder 32. However, the precise slope of gradual taper 56 can vary to accommodate particular brands or types of toothbrush 10, and the coefficient of friction between the toothbrush 10 and the holder 32. The gradual taper 56 provides a gripping force, wedging force, or frictional force when shoulder region 12 is inserted into recess 33, thereby securing the toothbrush 10 in holder 32.

Stated slightly differently, the recess 33 provides on its inner surface a recess surface contour 34 comprising a slot 51 and opposing grip regions 52. The slot 51 has a rear surface 36 and side surfaces 38 orthogonally adjacent the rear surface 36. The slot 51 includes a relatively wide body opening or channel 50 adapted to receive the body portion 16 of the toothbrush 10; a relatively narrow neck opening or channel 48 disposed above the body opening 50 and adapted to receive the neck portion 18 of the toothbrush 10; and sloped shoulder surfaces disposed symmetrically on each side of the slot 51. The sloped shoulder surfaces adjoin the sides of the neck opening 48 with the sides of the body opening 50 on each side of the slot 51. The slot 51 has a depth which exceeds the thickness 22 of the toothbrush handle 13 in the shoulder or shank region 12.

The opposing grip regions 52 are disposed symmetrically on each side of the body opening 50 of the slot 51. The opposing grip regions 52 are also disposed substantially near the front of the body opening 50. The opposing grip regions 52 each partially overlap the front of the body opening 50 of the slot 51. A space is provided between the two grip regions 52 such that the two grip regions 52 are closer in proximity to each other than the side walls of the body opening 50 but are further away from each other than the side walls of the neck opening 48.

Each opposing grip region 52 includes a grip surface 54 facing substantially in an opposing direction to the rear surface 36 of the slot 51. The grip surface 54 preferably includes a gradual taper or angular setoff 56 with respect to a plane parallel to the rear surface 36 of the slot 51. Each grip surface 54 engages a partial portion of the body portion 16 of the handle 13, said partial portion comprising the front side edges of the body portion 16 in the shoulder or shank region 12, when the toothbrush 10 is inserted into the holder 32.

FIG. 5 illustrates structural aspects of a semi-spherical holder 32 in accord with principles of the present invention. Holder 32 preferably comprises a mounting portion 60 and a mounting plate 62 affixed to the rear of mounting portion 60. Preferably, mounting portion 60 and mounting plate 62 are made from clear or translucent polycarbonate plastic. However, other materials such as butyryl resin, acetate or propionate could be used. Also, mounting portion 60 and mounting plate 62 could be integrally formed as a single unit.

FIG. 5 illustrates mounting portion 60 having a substantially semi-spherical shape with steps or ridges 64 formed therein for an aesthetic effect. Also illustrated in the sectional view of FIG. 5 are grip regions 52, gradual tapers 56 (see FIG. 4) on grip surfaces 54, and recess sloped portions 58, as described above. A hollow region 57 is preferably disposed in the mounting portion 60 below (behind) the recess 33 to limit shrinkage and deformation during thermal casting and cooling of the plastic material.

As illustrated in FIG. 6, a detailed joint between mounting portion 60 and mounting plate 62 preferably includes a triangular ridge tip or stud 63 disposed on a flange 65 of mounting plate 62. Flange 65 has a reduced thickness compared to the thickness of mounting plate 62. A shelf or inset 61 is provided on the inside edge of mounting portion 60. Flange 65 engages inset 61 forming lapped corner, or butt joint 67. The ridge 63 engages a bottom surface 69 of mounting portion 60. However, other types of joint can be provided without detracting from principles of the present invention, such as a simple recessed joint.

The ridge 63 provides filler material for forming a plastic weld or bond in the corner joint 67 during ultrasonic welding of the mounting portion 60 to the mounting plate 62. Adhesive, double-sided pressure sensitive adhesive tape, or other mounting means 44 is disposed between the rear surface 43 of mounting plate 62 and vertical surface 42, securing holder 32 to the vertical surface 42.

As illustrated in FIG. 7, an ornament, character, or toy configuration 66 may be provided for use with toothbrush holder 32. Preferably, ornament 66 is relatively thin for mounting close to a surface. An opening 70 may be included in ornament 66, having dimensions suitable for mounting or securing the ornament 66 to the holder 32. Alternatively, the holder 32 may be mounted to the ornament 66, which would include a mounting region thereon.

As illustrated in FIG. 8, in another aspect embodying principles of the present invention, a toothbrush holder 132 is provided to hold more than one toothbrush 10. Specifically, two recesses 133 are disposed symmetrically on semispherical mounting portion 160 of holder 132. Each recess 133 forms a recess surface contour 134. The details of each recess surface contour 134 are substantially as described above for a recess surface contour 34 in a single toothbrush holder 32. A mounting plate 162 is preferably joined to the rear of mounting portion 160. The details for joining mounting portion 160 and mounting plate 162 are substantially as described above with regard to the joining of mounting portion 60 and mounting plate 62 for a single toothbrush holder 32.

Some of the preferable dimensions for a semi-spherical toothbrush holder 32 as described above and shown in the drawings are as follows for engaging and holding a particular brand of toothbrush 10. However, these dimensions are easily adaptable to secure virtually any brand or type of toothbrush 10. The approximate average cross-sectional thickness of the mounting portion 60 and of the mounting plate 62 is approximately 0.062 inch. Of course, the cross-section of the mounting portion 60 varies in some regions. The overall diameter of the mounting member or holder 32 is approximately 1.5 inches. The overall depth of the mounting member or holder 32 is approximately 0.73 inch at its deepest point.

The overall depth of the slot 51 in the recess 33 is approximately 0.303 inch at the deepest portion which is roughly centered on the rear surface 36 of the recess 33. The body opening 50 of the slot 51 is preferably approximately 0.475 inch wide, measured between the sidewalls 38 in that region. The neck opening 48 of the slot 51 is preferably approximately 0.260 inch wide as measured between the sidewalls 38 in that region. Each of the grip regions 52 preferably overlaps the body opening 50 by approximately between 0.04 inch and 0.108 inch along its respective length. The distance between the grip regions 52 is preferably approximately 0.260 inch apart at the narrowest point and approximately 0.395 inch apart at the widest point. The slope of gradual taper 56 is preferably 3 about degrees, although other similar angles may be used depending on the coefficient of friction between the toothbrush 10 and the holder 32.

The inset 61 on the back perimeter of mounting portion 60 is preferably approximately 0.025 inch forming a ledge with that dimension. The mounting plate 62 may either be fully recessed within the inset 61 (not shown) or may have flange 65 formed integrally along its edges to accommodate inset 61 and to form the lapped corner joint 67 (shown in FIG. 6).

Although the foregoing detailed description discloses preferred aspects embodying principles of the present invention, one of ordinary skill in the art would understand that such detailed aspects of the present invention are subject to numerous modifications or alterations. For example, mounting member or holder 32 can be formed or constructed out of a single piece of material. The holder 32 can be provided in many different geometric shapes. The recess surface contour 34 of recess 33 can be adapted to secure virtually any toothbrush using virtually any localized surface region of the toothbrush handle 13. The gradual tapers 56 can be placed in various positions within the recess surface contour 34, such as on the back surface 36 of slot 51, or on the side walls 38 of slot 51 to primarily engage the sides of the handle 13 rather than the front and rear surface. Alternatively, the gradual taper 56 can be incorporated onto the toothbrush handle 13 by providing a wedge portion on the toothbrush 10. Accordingly, the present invention is not limited to the specific embodiments shown in the drawings and described in detail hereinabove.

What is claimed is:

1. A hygienic toothbrush mounting system, comprising:

a toothbrush; and a toothbrush holder;

said toothbrush including bristles and a handle;

said handle having a relatively uniform thickness and a front surface, a rear surface, and side surfaces;

said handle including a head portion, a body portion, a relatively narrow neck portion disposed between said head portion and said body portion and a shoulder region having shoulder surfaces where said neck portion adjoins said body portion;

said bristles being mounted on said head portion;

said shoulder region having a shoulder surface contour comprising said shoulder surfaces, a portion of said front surface associated with each of said neck portion and said body portion, a portion of said rear surface associated with each of said neck portion and said body portion, and a portion of said side surfaces associated with each of said neck portion and said body portion;

said toothbrush holder including a mounting portion and a mounting plate including a flange;

said mounting portion having a rigid geometric shape;

said geometric shape having a thickness exceeding said toothbrush handle thickness;

said mounting portion including a recess and an inset;

said recess providing a recess surface contour comprising a slot and opposing grip regions;

said slot having a rear surface and side surfaces;

said slot including a relatively wide body opening adapted to receive said body portion of said toothbrush, a relatively narrow neck opening disposed above said body opening and adapted to receive said neck portion of said toothbrush, and shoulder portions disposed symmetrically on each side of said slot adjoining said neck opening and said body opening;

said opposing grip regions being disposed symmetrically on each side of said body opening of said slot and also being disposed substantially near a front portion of said slot;

each of said opposing grip regions partially overlapping a front opening of said body opening portion of said slot and further inducting a grip surface facing substantially in an opposing direction to said rear surface of said slot;

said grip surface including a gradual taper;

said inset comprising a ledge at a rear of said mounting portion;

said mounting plate flange engaging said inset providing a lapped corner joint for securing said mounting plate to a mounting member;

said holder being adapted to be fixed to a vertical surface in contact with said mounting plate with said neck opening of said slot oriented upwardly and with said body opening of said slot oriented downwardly; and said toothbrush being secured in said toothbrush holder by substantially engaging said shoulder surface contour in said recess surface contour by sliding said shoulder region into said recess using a linear motion of said handle.

2. The system of claim 1, wherein said rigid geometric shape is formed of translucent material.

3. A hygienic toothbrush mounting system, comprising:

a toothbrush including a handle region having a predetermined surface contour;

a mounting member having a recessed surface contour for engaging said predetermined surface contour of said handle region;

said toothbrush secured in said mounting member by friction between portions of the engaged surface contours;

said handle region comprises a shoulder region including a front surface and a rear surface;

said shoulder region having a predetermined thickness;

said recessed surface contour includes a slot having side surfaces and a rear surface;

said side surfaces being disposed orthogonally to said rear surface and providing a depth to said slot in excess of said predetermined shoulder region thickness;

at least one tapered grip surface opposing said rear surface of said slot; and said rear surface of said slot and said at least tapered opposing grip surface substantially engaging said front and rear surfaces of said shoulder region causing the friction.

4. The system of claim 3, wherein said mounting member is adapted to be affixed to a vertical surface.

5. A hygienic toothbrush mounting system, comprising:

a toothbrush including a handle region having a predetermined surface contour; and a mounting member having a recessed surface contour for engaging said predetermined surface contour;

wherein said toothbrush is secured in said mounting member by friction between portions of the engaged surface contours;

wherein said recessed surface contour includes a first surface substantially oriented in opposition to a second surface;

wherein said predetermined surface contour of said handle region is in contact between and secured by said first surface and said second surface;

wherein said first surface further comprises a tapered surface disposed at a gradual angle substantially opposing said second surface; and wherein said second surface comprises a planar surface at a rear of a slot provided in said mounting member, said slot having sidewalls shaped to guide side portions of said predetermined surface contour of said handle during insertion of said predetermined surface contour into said recessed surface contour.

6. The system of claim 5, wherein:

said predetermined surface contour further comprises a relatively narrow neck portion of said handle, a relatively wide body portion of said handle, and a sloped shoulder surface adjoining said neck portion and said body portion on each side of said handle;

said neck portion is disposed above said body portion;

said slot further comprises a relatively narrow neck opening between said sidewalls, a relatively wide body opening between said sidewalls, and a sloped shoulder surface adjoining each neck opening sidewall and each body opening sidewall on each side of said slot; and said neck opening is disposed above said body opening.

7. A precision toothbrush mounting system, comprising:

a toothbrush having a handle, said handle including a reduced shank portion between a head portion and a body portion thereof;

said handle including a predetermined mounting surface in the region of said reduced shank portion, said mounting surface having a predetermined thickness;

a toothbrush holder having front and rear sides, said holder having a fiat rear surface on the rear side thereof for engaging a flat surface, and a recess on the front side thereof, said recess having a depth adequate to encompass said predetermined mounting surface thickness and having grip regions to extend around said handle to restrain said handle against movement directly outwardly from said holder;

said predetermined mounting surface and said recess having a gradually tapered interference fit to retain said toothbrush in said holder;

said recess further comprises a slot having opposing side walls and a rear surface, each of said side walls disposed in orthogonal relationship with said rear surface and also being shaped to correspond to a respective side profile of said predetermined mounting surface.

8. The system of claim 7, wherein said toothbrush holder comprises a translucent plastic material.

9. The system of claim 7, wherein said toothbrush holder is adapted to be mounted to a mirror.

10. A precision toothbrush mounting system, comprising:

a toothbrush having a handle, said handle including a reduced shank portion between a head portion and a body portion thereof;

said handle including a predetermined mounting surface in a region of said reduced shank portion, said mounting surface having a predetermined thickness;

a toothbrush holder having front and rear sides, said holder having a flat rear surface on the rear side thereof for engaging a flat surface, and a recess on the front side thereof, said recess having a depth adequate to encompass said predetermined mounting surface thickness and having opposing grip regions to extend around said handle to restrain said handle against movement directly outwardly from said holder;

said predetermined mounting surface and said recess having a gradually tapered interference fit to retain said toothbrush in said holder;

said recess includes a slot having opposing side walls and a rear surface, each of said side walls disposed in orthogonal relationship with said rear surface providing a front opening therebetween, and also being shaped to correspond to a respective side profile of said predetermined mounting surface; and each of said opposing grip regions includes a ledge overlapping said front opening on opposing sides thereof.

11. The system of claim 10, wherein each of said opposing grip regions includes a gradually tapered grip surface disposed in substantially opposing direction with respect to said rear surface of said slot, thereby providing said gradually tapered interference fit.

12. The system of claim 11, wherein:

said toothbrush holder comprises a mounting portion and a mounting plate;

said recess is provided on a front region of said mounting portion and said flat rear surface is provided as a back surface of said mounting plate;

said mounting portion is provided in a rigid geometric shape having a substantially hollow interior beneath said recess and also including an inset ledge disposed at a rear perimeter of said mounting portion;

said mounting plate comprises a flat shape corresponding to the shape of said rear perimeter of said mounting portion and having a flanged edge; and said flanged edge adjoins said inset ledge providing a lapped corner joint for securing said mounting plate to said mounting portion.

13. The system of claim 10, wherein the toothbrush holder is adapted to be mounted to a mirror.

* * * * *